US007348870B2

(12) United States Patent
Hsu et al.

(10) Patent No.: US 7,348,870 B2
(45) Date of Patent: Mar. 25, 2008

(54) STRUCTURE AND METHOD OF FABRICATING A HINGE TYPE MEMS SWITCH

(75) Inventors: Louis C. Hsu, Fishkill, NY (US); Timothy Dalton, Ridgefield, CT (US); Lawrence Clevenger, LaGrangeville, NY (US); Carl Radens, LaGrangeville, NY (US); Kwong Hon Wong, Wappingers Falls, NY (US); Chih-Chao Yang, Beacon, NY (US)

(73) Assignee: International Business Machines Corporation, Armonk, NY (US)

( * ) Notice: Subject to any disclaimer, the term of this patent is extended or adjusted under 35 U.S.C. 154(b) by 319 days.

(21) Appl. No.: 10/905,449

(22) Filed: Jan. 5, 2005

(65) Prior Publication Data

US 2006/0145792 A1 Jul. 6, 2006

(51) Int. Cl.
*H01H 51/22* (2006.01)

(52) U.S. Cl. ..... 335/78; 200/181

(58) Field of Classification Search ..... 200/181; 335/78

See application file for complete search history.

(56) References Cited

U.S. PATENT DOCUMENTS 6,143,997 A 11/2000 Feng et al.
6,399,406 B2 6/2002 Chan et al.
6,426,687 B1 * 7/2002 Osborn ..... 333/262
6,452,124 B1 9/2002 York et al.
6,504,118 B2 * 1/2003 Hyman et al. ..... 200/181
6,777,629 B2 * 8/2004 Lane et al. ..... 200/181
6,841,839 B2 * 1/2005 Sridhar et al. ..... 257/415

* cited by examiner

*Primary Examiner*—Elvin Enad
*Assistant Examiner*—Bernard Rojas
(74) *Attorney, Agent, or Firm*—H. Daniel Schnurmann

(57) ABSTRACT

A hinge type MEMS switch that is fully integratable within a semiconductor fabrication process, such as a CMOS, is described. The MEMS switch constructed on a substrate consists of two posts, each end thereof terminating in a cap; a movable conductive plate having a surface terminating in a ring in each of two opposing edges, the rings being loosely connected to guiding posts; an upper and lower electrode pairs; and upper and lower interconnect wiring lines connected and disconnected by the movable conductive plate. When in the energized state, a low voltage level is applied to the upper electrode pair, while the lower electrode pair is grounded. The conductive plate moves up, shorting two upper interconnect wirings lines. Conversely, the conductive plate moves down when the voltage is applied to the lower electrode pair, while the upper electrode pair is grounded, shorting the two lower interconnect wiring lines and opening the upper wiring lines. The MEMS switch thus formed generates an even force that provides the conductive plate with a translational movement, with the displacement being guided by the two vertical posts.

13 Claims, 15 Drawing Sheets

STRUCTURE AND METHOD OF FABRICATING A HINGE TYPE MEMS SWITCH

BACKGROUND OF THE INVENTION

This invention generally relates to micro-electromechanical system (MEMS) switches, and more particularly, to a hinge type MEMS switch and a method of fabricating the same using current state of the art semiconductor fabrication processes, such as a CMOS process.

Switching operations are a fundamental part of many electrical, mechanical and electromechanical applications. MEMS switches have drawn considerable interest over the last few years, leading to the design and development of a variety of products using MEMS technology that have become widespread in biomedical, aerospace, and communications systems applications.

Conventional MEMS typically utilize cantilever switches, membrane switches, and tunable capacitor structures, as described, e.g., in U.S. Pat. No. 6,160,230 to McMillan et al., U.S. Pat. No. 6,143,997 to Feng et al., U.S. Pat. No. 5,970,315 to Carley et al., and U.S. Pat. No. 5,880,921 to Tham et al. MEMS devices are manufactured using micro-electro-mechanical techniques and are mainly used to control electrical, mechanical or optical signal flows. Such devices, however, present many problems because their structure and innate material properties require that they be manufactured in lines that are separate from conventional semiconductor manufacture processing. This is usually due to materials and processes which are incompatible and which cannot be integrated within existing semiconductor fabrication lines.

Implementing MEMS (micro-electromechanical systems) switches for semiconductor applications has many advantages, such as: (1) low insertion loss, (2) low or no DC power consumption, (3) high linearity, and (4) broad bandwidth performance. However, it must be provided with a low actuation-voltage switch and must not suffer from stiction, that is, the inability to restore the switch to its original state when desired. A conventional cantilever type switch, as shown in FIGS. 1A-1B or a membrane type switch, as illustrated in FIGS. 2A-2B typically requires 10 to 100 V operating voltage, which is unsuited for integration with state-of-the-art integrated circuits.

Referring back to the aforementioned U.S. Pat. No. 6,143,997, to Feng at al., and in particular, to FIG. 1A illustrated therein, a prior art cantilever switch is shown in a resting position with the cantilever portion a distance $h_A$ away from an RF transmission line creating an off state, since the distance $h_A$ prevents current from flowing from the cantilever to the transmission line below it. To turn the switch on, as shown in FIG. 1B, a large switching voltage, typically in the order of 28 Volts, is necessary to overcome physical properties and bend the metal down to contact the RF transmission line. In the energized state, with the metal bent down, an electrical connection is created between the cantilever portion and the transmission line. Thus, the cantilever switch is on when it remains in the excited state.

Referring to FIGS. 2A-2B, Feng et al. show a membrane switch, respectively, in a resting and energized position. When the membrane switch remains in its resting position, current is unable to flow from the membrane to an output pad and the switch is turned off. Similar to the cantilever switch, a high actuation voltage, typically 38 to 50 volts, is necessary to deform the metal and activate the switch. In the excited state, the membrane is deformed to contact a dielectric layer on the output pad, thereby electrically connecting the membrane to the output pad to turn the switch on. This design also requires a relatively high voltage.

In contrast to cantilever switches, the switching action for hinge type MEMS switches requires very low actuation voltage, typically less than 3 volts, mainly because they lack mechanical bending action. U.S. Pat. No. 6,143,997 to Feng et al. describes this type of switch. Referring to FIG. 3, the switch pad moves up and down freely along hinge bracket 22. In a relax state, as shown in FIG. 3A, the pad is attracted by a lower electrode 20, forcing it to stay at the lower level. In an energized state, as illustrated in FIG. 3B, the pad is attracted by the top electrode 30, moving it to the top level. It is worth noting that the metal pad, i.e., movable element 17, makes contact with dielectric 32 when in the upward position, and with, e.g., dielectric 18, when in a downward position. Thus, the MEMS switch described only operates as an RF switch, adequate for a high frequency environment, wherein pad 17 and electrodes 20 act as the metal plates of a capacitor separated by a dielectric layer which acts as an open circuit for a DC voltage, but as a short for an AC voltage. Furthermore, the process steps to fabricate a hinge-type MEMS switch are not described by Feng et al., and no reference is made on how to integrate this type of MEMS switches alongside with back-end-of-the-line (BEOL) metal interconnects of a conventional semiconductor chip.

Another type of MEMS switch is described by L. Frenzel, in the article "MEMS Switch Puts SoC Radios on the Cusp", Electronic Design, p. 29, Jun. 9, 2003, that uses a combination of thermal and electrostatic actuation. These devices have been used for band and circuit reconfiguration in a multi-band/multi-mode RF system. In order to change the state of the switch, each time 20 mA current must be applied, which is not practical for a CMOS chip environment.

More and more MEMS switches are emerging for RF applications. For example, STMicroelectronics describes a combination of thermal and electrostatic actuation type MEMS switches for mode of operation and circuit configurations designed for multi-mode and multi-band RF system applications. Such switches also require 20 mA of current to heat the device and allow it to switch. High-currents of this magnitude are not suitable for CMOS applications. To date, conventional MEMS switches are not CMOS compatible because: (1) they are difficult to integrate using MOS process steps and, (2) they require a high-current and high actuation operation voltages.

Thus, there is a need in industry for an improved MEMS, particular, a hinge-type MEMS switch that is suited for a wide range of semiconductor switching applications, spanning from RF, optical, mechanical, package, cooling, and extending to include CMOS circuit applications, and which are characterized by having a low actuation voltage (less than 3 V) and which can easily be integrated within conventional integrated circuit (IC) manufacturing lines.

OBJECTS AND SUMMARY OF THE INVENTION

Accordingly, it is an object of the invention to provide a hinge type MEMS switch operating at a voltage compatible with typical CMOS operating voltages.

It is another object to provide a hinge type MEMS switch having a low-power actuation voltage (less than 3 V).

It is still another object to fabricate a hinge-type MEMS switch using state-of-the-art BEOL (back-end-of-line) interconnects without adding extra process steps or material.

It is a further object to provide a hinge type MEMS switch which construction is limited to using only three metal levels.

These and other objects, aspects and advantages of the invention are accomplished by a hinge type MEMS switch built on a substrate consisting of two posts, preferably terminating in a bottom cap and a top cap; a movable conductive plate consisting of a body having two opposing edges terminating in rings loosely coupled to the posts; a top electrode pair and a bottom electrode pair, preferably facing each other; top metal wiring lines co-planar with one another to be connected and disconnected by the conductive plate, and preferably, bottom metal wiring lines, co-planar with one another, likewise, opened and shorted by the conductive plate.

The operation of the switch is as follows: when in the energized state, a voltage level of the order of 3V is applied to the upper electrode pair. When grounding the lower electrode pair, the conductive plate moves up, shorting the two upper wirings lines. Conversely, the conductive plate moves downward when a voltage level of the order of 3V is applied to the lower electrode pair while grounding the upper electrode, shorting the two lower wiring lines.

The MEMS switch thus formed provides an even force to the switch when applying a voltage, respectively, to the upper and lower electrode pair, forcing the conductive plate to move up and down, with the conductive plate movement being guided by the two vertical posts.

The MEMS switch of the present invention is easily integrated in an IC chip. All the elements forming the switching device are fabricated using semiconductor back-end-of-the-line (or BEOL) process, and as such, these switches can easily be manufactured alongside other semiconductor devices and circuits on the same substrate.

One aspect of the invention provides a micro-electromechanical system switch that includes: upper and lower electrodes; a movable conductive plate positioned between the upper and lower electrodes; and guiding means coupled to the movable conductive plate for guiding the movement of the movable conductive plate between the upper and the lower electrodes.

Another aspect of the invention provides a method of fabricating a MEMS switch on a substrate that includes the steps of: i) forming at least one depletion area within the substrate, followed by a blanket deposition of an etch stop layer thereon; ii) depositing a first metallization layer on the substrate followed by a first dielectric layer, and patterning the first metal layer with a first portion of the metal residing within the depletion and a second portion thereof residing outside the depletion area, and patterning the first dielectric layer, leaving dielectric only on top of the metal residing within the depletion area, forming at the first metallization layer: a) bases for hinge posts, b) lower electrodes and c) lower interconnect wiring; iii) blanket depositing and planarizing a second dielectric layer deposited thereon, to form conductive vias in areas where interconnects are expected, the vias becoming a first portion of hinges; iv) depositing a second dielectric layer a second metallization layer followed by patterning to form: a) the lower electrodes, b) links to upper electrodes to be formed thereafter, c) a movable conductive plate with holding rings on two opposing edges of the movable conductive plate, and d) a second portion of the hinge posts; v) blanket depositing a third dielectric layer thereon followed by patterning, forming conductive vias in areas where interconnects are expected to become the third portion of the hinges, and interconnect wiring to provide links to the upper electrodes to be formed thereafter; vi) depositing a fourth dielectric layer, followed by a deposition a third metallization layer thereon, and patterning to form: a) upper hinge caps, b) the upper electrodes, and c) upper interconnect wiring; and vii) depositing a fifth dielectric serving as a hard mask, and opening a cavity down to the etch stop layer to allow the conductive plate to move freely.

BRIEF DESCRIPTION OF THE DRAWINGS

The accompanying drawings, which are incorporated in and which constitute part of the specification, illustrate presently preferred embodiments of the invention and, together with the general description given above and the detailed description of the preferred embodiments given below serve to explain the principles of the invention.

in FIG. 5B, wire C is selectively connected to either one of two wires D1 and D2; and FIG. 5C, a first wire E1-F1 is connected to a second wire E2-F2, and vice versa.

DETAILED DESCRIPTION OF THE INVENTION

Figure 1A:
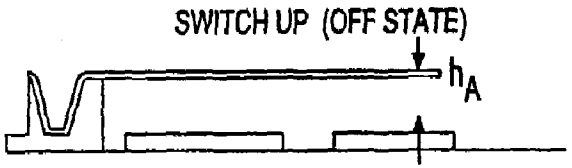
FIG. 1A (PRIOR ART)
FIGS. 1A-1B illustrate a prior art cantilever type MEMS switch, respectively, in the relaxed and energized state.
Figure 1B:
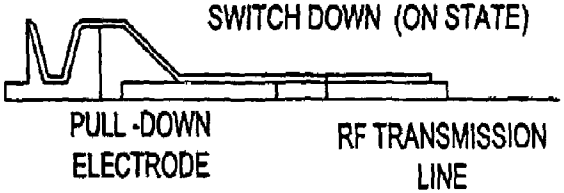
FIG. 1B (PRIOR ART)
Figure 2A:
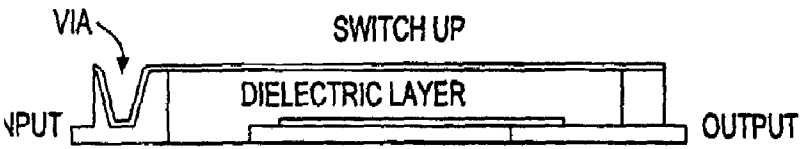
FIG. 2A (PRIOR ART)
FIGS. 2A-2B illustrate a prior art membrane type MEMS switch, respectively, in the relaxed and energized state.
Figure 2B:
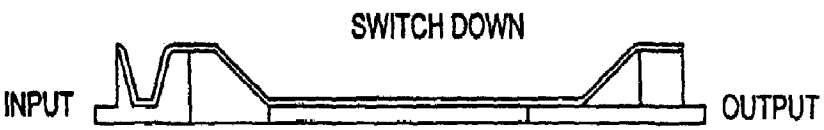
FIG. 2B (PRIOR ART)
Figure 3A:
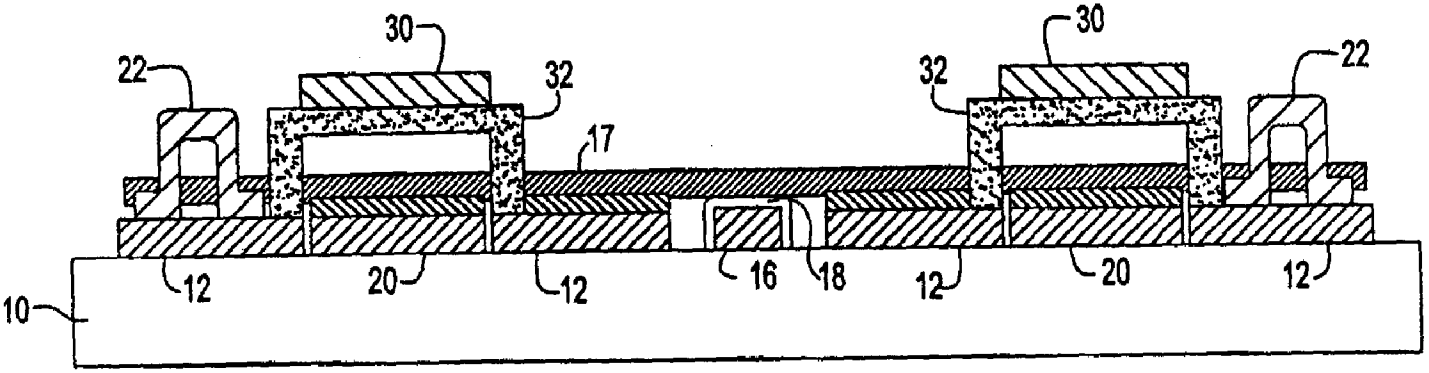
FIG. 3A (PRIOR ART)
FIGS. 3A-3B illustrate a prior art hinge type MEMS switch, respectively, in the relaxed and energized state.
Figure 3B:
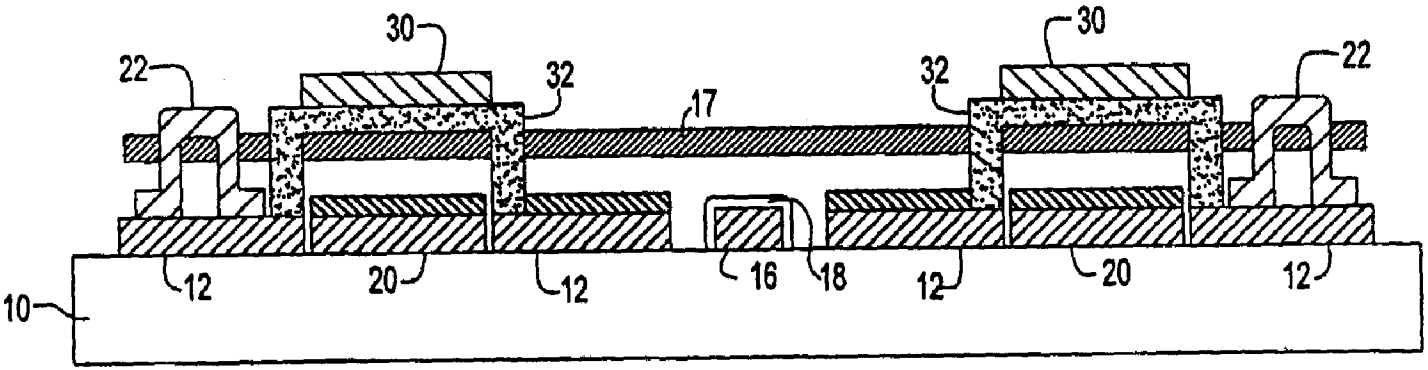
FIG. 3B (PRIOR ART)
Figure 4:
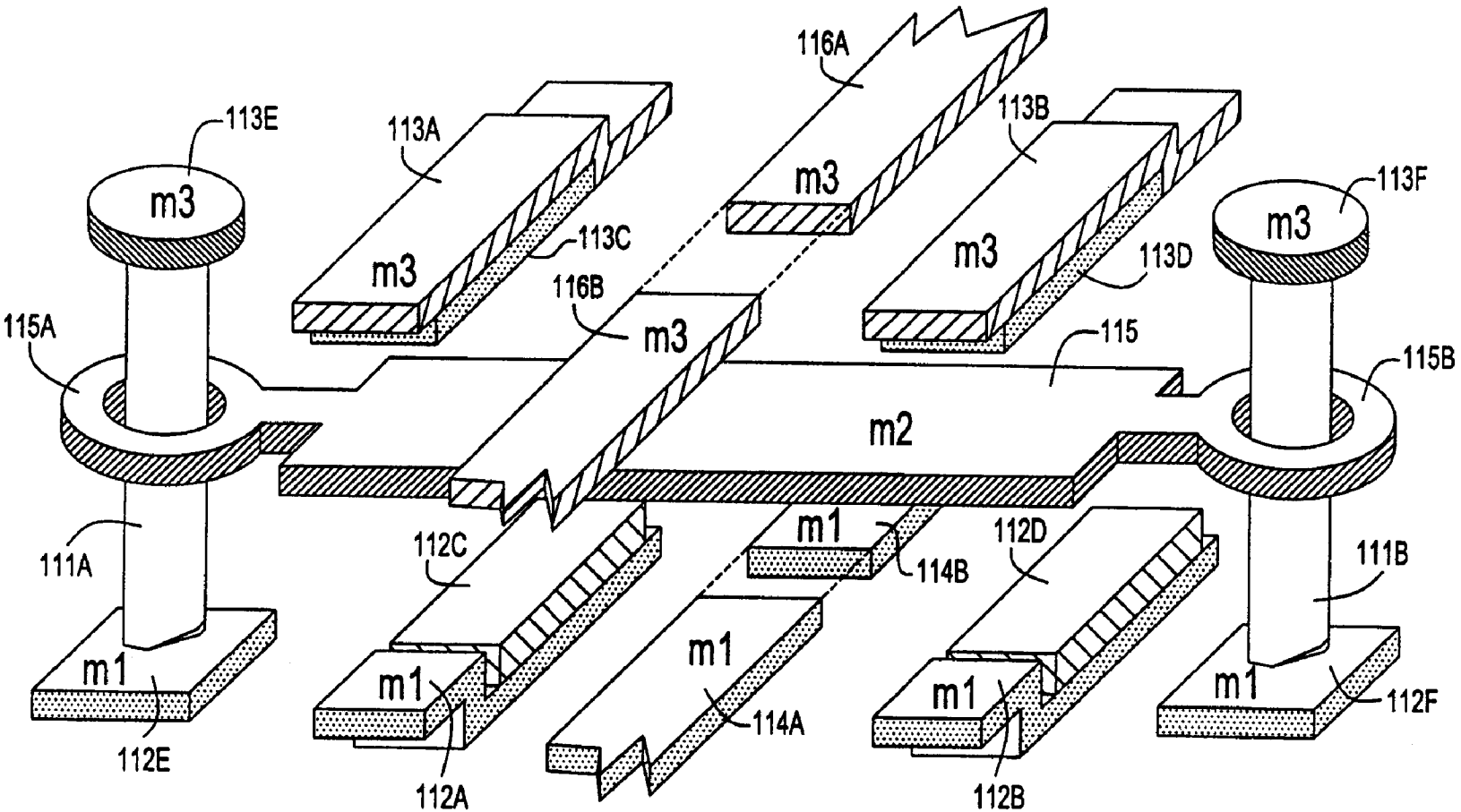
FIG. 4 shows a three dimensional view of the hinge type MEMS switch, according to the present invention.

Referring now to the drawings and, more particularly, to FIG. 4 there is shown a three dimensional view of the hinge-type switch of the present invention.

As previously described, the MEMS switch is activated by a low actuation voltage, which has the advantage of making the switch compatible with voltages that are characteristic of semiconductor devices, in particular CMOS technology. This is made possible by the device not having to rely on a deformable moveable beam, that is typical of, e.g., cantilever MEMS switching devices and the like.

Still referring to FIG. 4, the structure is shown consisting of two guiding posts 111A and 111B, each formed by a column terminating, respectively, in a bottom and a top cap. The top cap is made of third metal (m3), preferably, having a size approximately 50% larger than the cross-sectional area of the column forming the post. The bottom cap is made of first metal (m1), which size, preferably, approximates the size of the top cap. The column forming the post is, advantageously, made of three portions of BEOL interconnect components, namely, a first stud (V1), a second metal (m2) and a second stud (V2). Thus, the traveling distance of the conductive plate is the summation of the three heights: V1+m2+V2.

The movable conductive plate consists of a planar surface 115, with opposing edges respectively ending in rings 115A and 115B integral to the planar surface of the movable conductive plate; a top pair of parallel electrodes 113A and 113B; a bottom electrode pair 112A and 112B, preferably facing the top pair; top interconnect wiring 116A and 116B, co-planar with one another to be shorted (or opened), and bottom interconnect wiring 114A and 114B, co-planar with one another, to be connected (or opened).

The MEMS switch is built on top of a substrate insulated with dielectric material. The MEMS switch itself does not require any devices to make it operable, except for the control of the upper and lower electrodes. By way of example, a power supply (not shown), preferably 3V, is needed to be directed to either upper or lower electrode when either one is activated. Therefore, a circuit (not shown) is needed to switch the power supply to the selected electrode and ground the unselected electrode. For simplicity and better illustration, only the MEMS portion is depicted in the diagram.

The MEMS switch is fabricated on top of an STI (shallow trench isolation) region (not shown) to isolate it from the silicon substrate. The voltage pulse that is applied to the lower electrode 112A and 112B is applied directly to the conductive portions of the electrodes. Similarly, the voltage pulse that is applied to the upper electrodes 113A and 113B is likewise, also directly applied to the conductive portion of the electrodes. The pulse characteristics are defined by a control circuit (not shown).

The switch operates as follows: when energized by a voltage (i.e., in the 'on' state), the conductive plate 115 moves upwards guided by the two posts 111A-111B keeping the plate in a substantially horizontal orientation, shorting the two co-planar upper wiring 116A-116B. This movement is prompted by energizing the electrode pair 113A-113B, preferably 3V, appropriate for semiconductor IC devices, and particularly for CMOS technology, while grounding the lower electrode pair 112A-112B. Likewise, the conductive plate moves vertically, retracing the same path downwards as when the switch was energized, shorting the two lower wiring lines 114A-114B. This is achieved by applying a voltage level, preferably 3V to the lower electrode pair 112A-112B while grounding the upper electrode pair 113A-113B.

Of particular relevance and importance are blocking dielectric pads 112C, 112D, 113C and 113D which allow upper electrodes 113A-113B to be coplanar, such that when movable pad (or plate) 115 short circuits metal lines 116A to 116B, the electrodes remain electrically insulated from the movable pad 115, avoiding a short to occur between the two electrodes and metal lines 116A-116B. A similar situation is applicable to the lower electrodes 112A-112B. The surfaces of the dielectric pads 112C-112D are coplanar with metal lines 114A-114B which remain electrically insulated from the electrodes by dielectric pads 112C-112D, respectively, when shorted by movable pad 115.

The aforementioned structure is advantageously used in various alternate configurations applicable to the hinge-type MEMS switch of the present invention. Shown in FIGS. 5A-5C are illustrated MEMS switches in several configurations that can readily be integrated with other semiconductor IC devices and circuits.

Figure 5A:
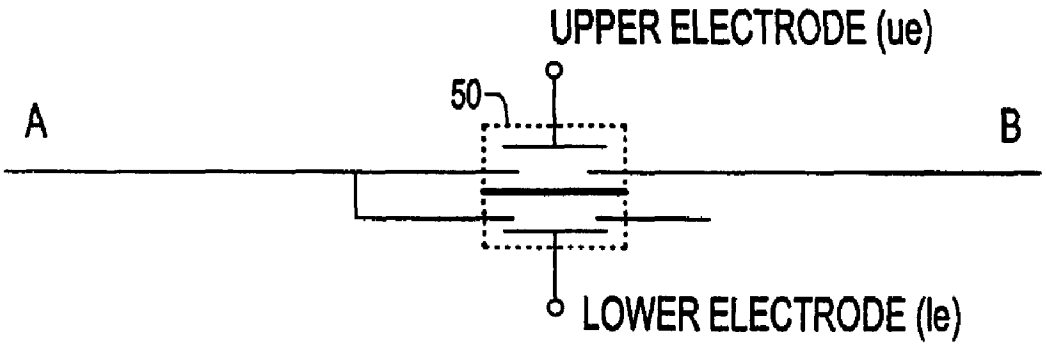
FIGS. 5A-C are side views of several switching configurations of the hinge type MEMS of the present invention, wherein in FIG. 5A the switch is shown turned on and off between the ends two lines A and B.

Referring now to FIG. 5A, the single pole, single throw configuration depicted above, schematically represented by box 50, is shown with the MEMS device switching on and off between the two ends A and B of a wire.

Figure 5B:
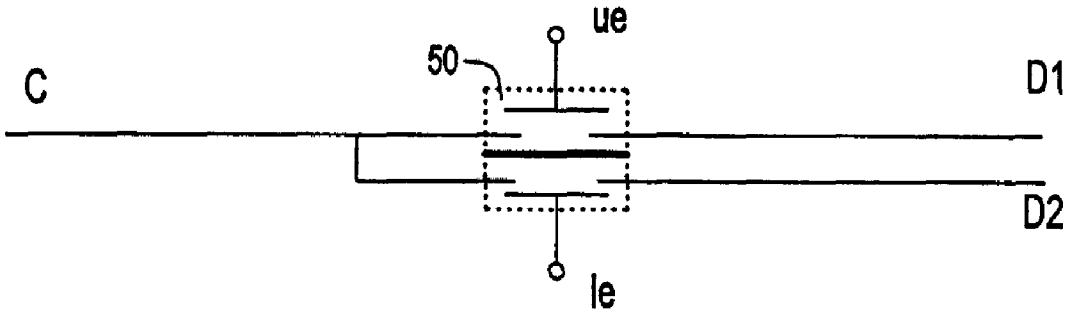

In FIG. 5B, the wire fans out in a top wire segment D1 and a bottom segment D2. The switch alternatively switches between each line segment, respectively energizing the upper MEMS electrode (also referenced "ue") and the lower electrode (or "le"). In this manner, the wire end C selectively connects to one or the other wire end, labeled D1 and D2.

Figure 5C:
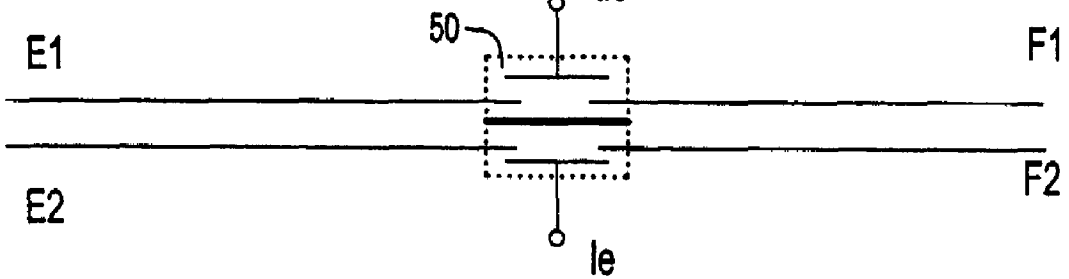

In FIG. 5C, the ends of two parallel wire line segments are selectively connected to the first wiring segment between ends E1 to F1, while the second wire segments E2 from F2 are disconnected, and vice versa.

Figure 6B:
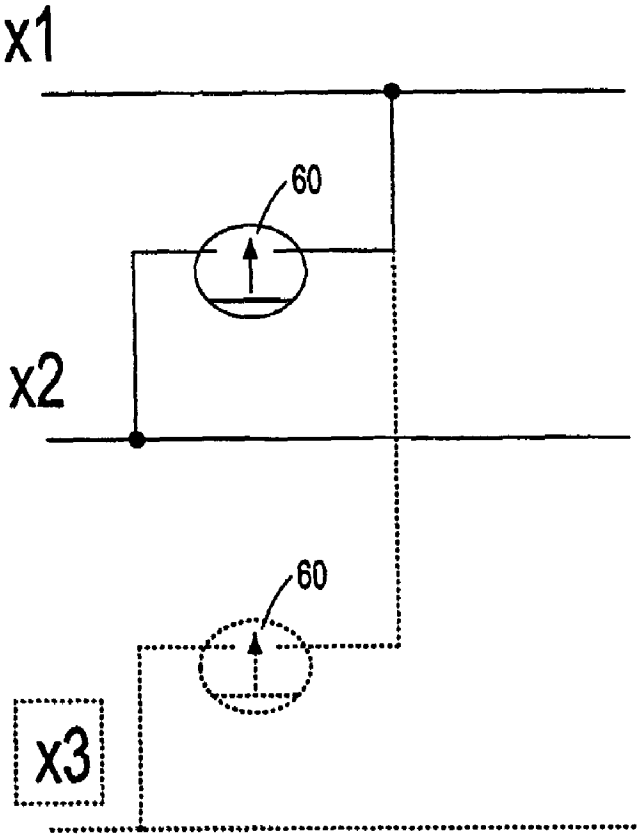
FIGS. 6A-6B are side views of further switching configurations of the hinge type MEMS of the present invention, showing in FIG. 6A the hinge type MEMS switch connecting (and disconnecting) a vertical line to (and from) horizontal lines x1, x2, and the like; and in FIG. 6B, the switch connecting more than two wiring lines traveling parallel to one another.
Figure 6A:
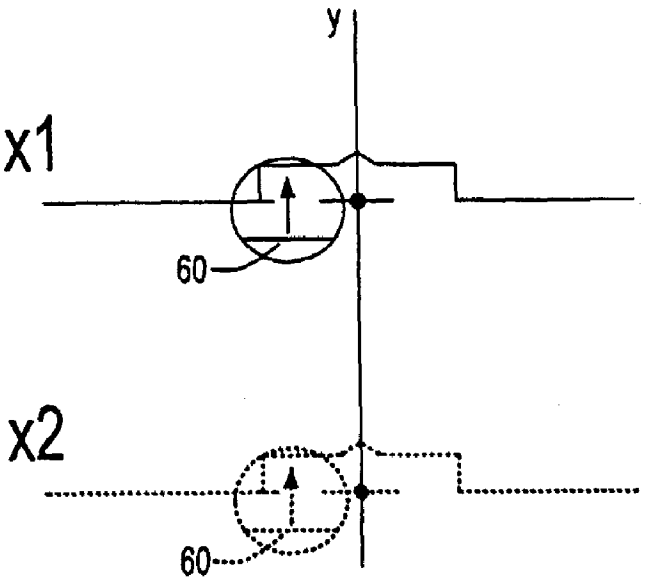

Referring now to FIGS. 6A-6B, two other configurations are shown, wherein two horizontal lines x1 and x2 are selectively connected to a vertical line y. Each MEMS switch is schematically shown enclosed in a circle, with the movable pad depicted as a horizontal line moving in a vertical direction (shown as an arrow) to close the switch, and in an opposite direction, to open it.

Such configurations find usefulness in a variety of applications, such as, e.g., power distribution grids. A power distribution grid is formed by a plurality of horizontal parallel power bus lines and a plurality of vertical parallel power bus lines. The conventional approach is to short every cross-over point of two orthogonal lines. This configuration presents many disadvantages, such as poor power supply uniformity due to non-uniform power consumption across the chip. In such an instance, it is advantageous to place a MEMS switch at each cross-over point to achieve better control on the power supply uniformity.

In FIG. 6B, two horizontal lines x2 and x3 are selectively connected to a third line x1 by way of two MEMS switches labeled 60. When both MEMS switches are closed, the three lines x1, x2 and x3 connect one another. When open, lines x2 and x3 are disconnected from x1.

Hinge-Type MEMS Switch Fabrication Steps

FIGS. 7-16 illustrate the various process steps to fabricate the MEMS switch of the present invention using CMOS technology.

Figure 7C:
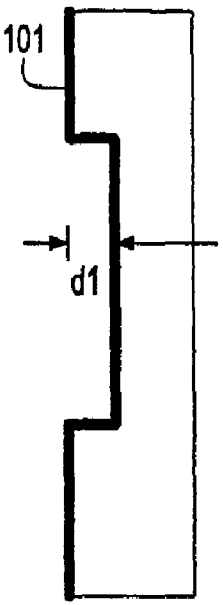
FIGS. 7 through 16 are schematic cross-sectional views illustrating the process steps for fabricating the MEMS switch of the present invention, wherein all the figures labeled 'A' represent a top view of the corresponding process step, all the figures labeled 'B' represent a cross-sectional view along line x-x', and all the figures labeled 'C' represent a cross-sectional view along line y-y'.
Figure 7A:
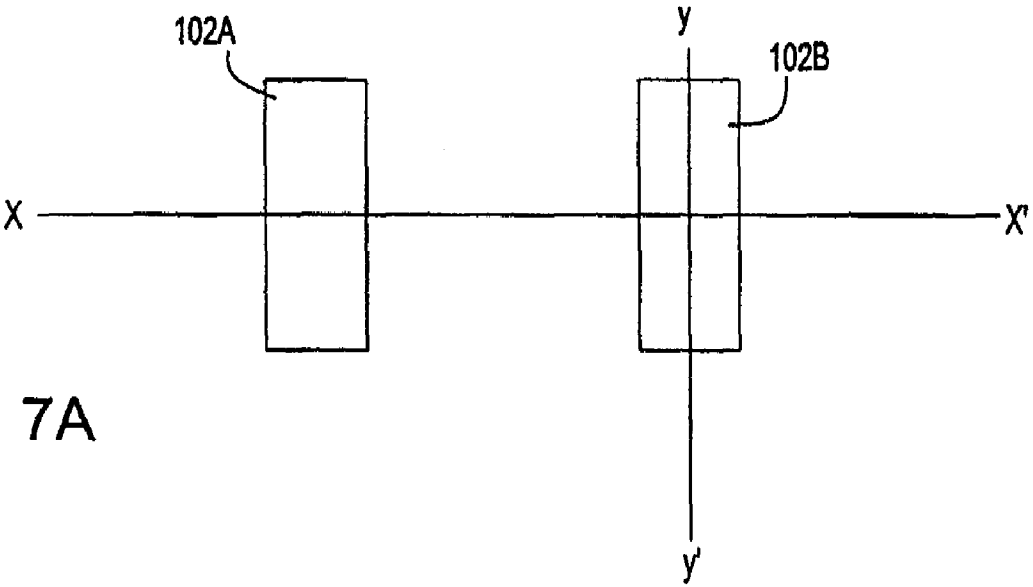
Figure 7B:
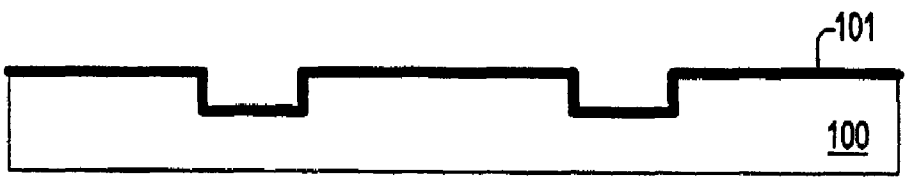

Referring to FIG. 7A, rectangular shaped depletion regions 102A and 102B (also referred to as cavities) with a depth d1 are formed on a wafer substrate 100. A preferred method of forming the depletion regions is described below. The wafer surface is first cleaned and coated thereafter with a layer of a known photosensitive polymeric material, generically referred to as photoresist. The photoresist is exposed by way of a photomask, preferably, in a lithographic exposure tool utilizing a suitable wavelength of light, known to those skilled in the art, to expose the photoresist. The exposed area is then dissolved in a solvent. Alternatively, rather than a "positive" photoresist, a "negative" photoresist may be advantageously employed where the non-exposed areas are removed during the develop process. Optionally, hardening the resist via baking in an oven is performed.

The substrate cavities are created by an etching agent, such as plasma, where an excited gaseous plasma is created within a vacuum vessel with the application of one or more electric fields to a vessel containing a gas mixture of one of more of the following: $Cl_2$, HBr, $SF_6$, $CF_4$, $O_2$, $N_2$, Ar, He, $NF_3$, or any other suitable gas or gas mixture known to one skilled in the art. The etch proceeds until a predefined depth "d1" is reached. A layer of etch stop film, such as aluminum oxide ($Al_2O_3$) 101 is then deposited. The stop film is prepared for future cavity formation. Thus, when the MEMS structure is completed, all the insulating material is removed so that the conductive plate of the MEMS is free to move. While etching away the insulating material, it is critical that no damage be done to the devices on the substrate. The stop film inhibits the etching species to attack the substrate.

Preferably, the depth "d1" ranges between 20 to 2000 nm, and the thickness of the stop film varies between 2 nm and 100 nm. The etch rate of insulating material to the stop film (known as selectivity) is of the order of 1000:1 in a $CF_4$ based plasma.

Figure 8C:
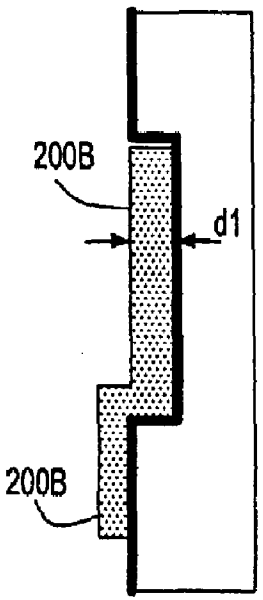
Figure 8A:
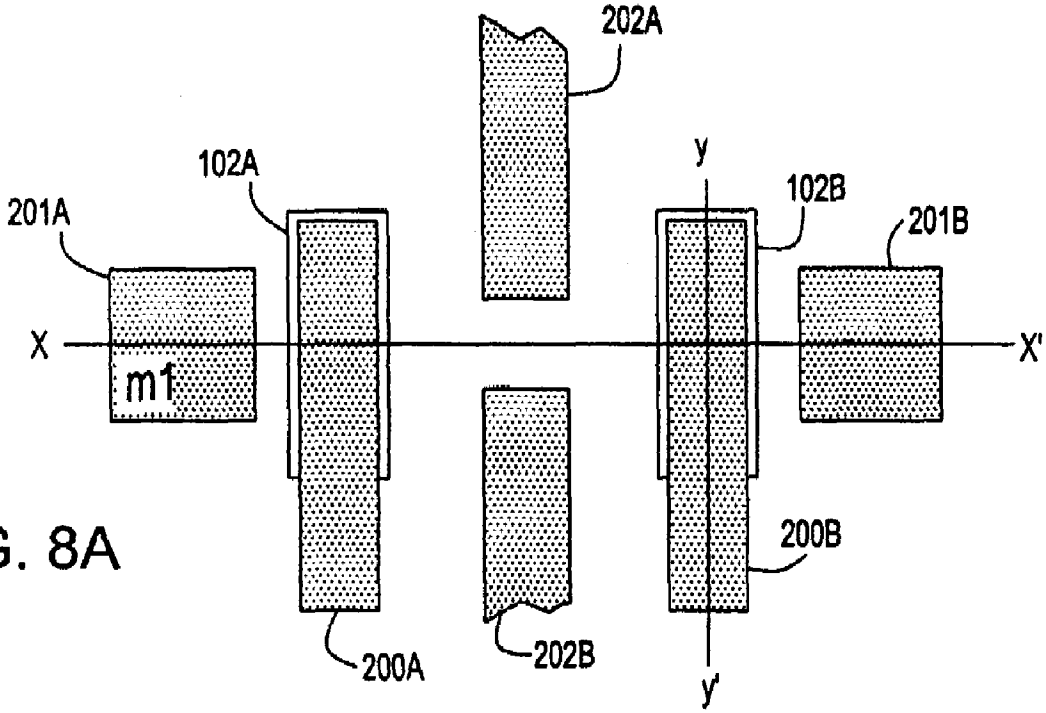
Figure 8B:
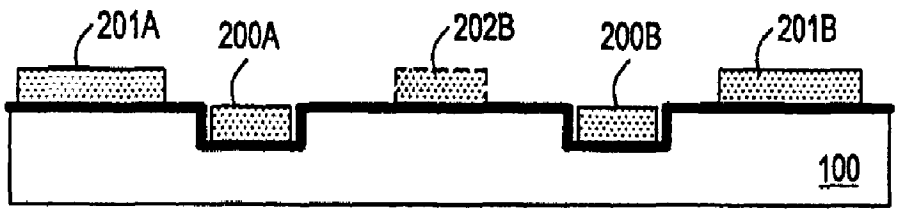

Referring to FIG. 8, the first metallization (m1) is performed through a conventional metallization process such as CVD (chemical vapor deposition), PVD (physical vapor deposition—ionized, collimated, or standard), or ALD (atomic layer deposition). It is subsequently patterned with a conventional photographic process. The metal is patterned using a plasma etching process with a gaseous mixture of one of more of the following: $Cl_2$, HBr, $BCl_3$, $O_2$, $N_2$, Ar, He, or any other suitable gas or gas mixture known to one skilled in the art. The etch proceeds until all of the metal which is not protected by the photo-resist has been removed from the non-photoresist masked regions. Preferably, the metals include Al, Cu, Ag, W, Ru, Ti, TiN, Ta, TaN, TiSiN, TaSiN, WN, WCN, and the like.

The thickness of the first metal is about the same as the depth of the depletion region "d1". Still in the first metallization layer (m1), features 201A and 201B are shown forming the bases of the hinge post. Features 200A and 200B form the bottom electrode pair, and features 202A and 202B become the connecting wiring. Note that portions of metal 200A and 200B are constructed outside depletion regions 102A and 102B. The thickness of the first metal (m1) is the same as the depth of the depletion regions.

Figure 9C:
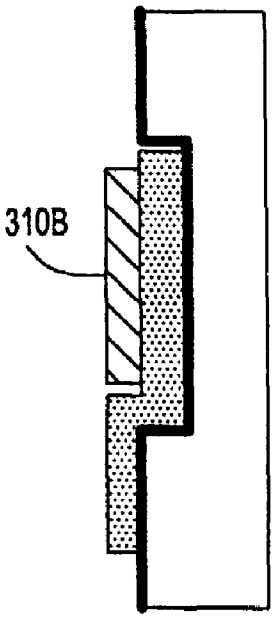
Figure 9A:
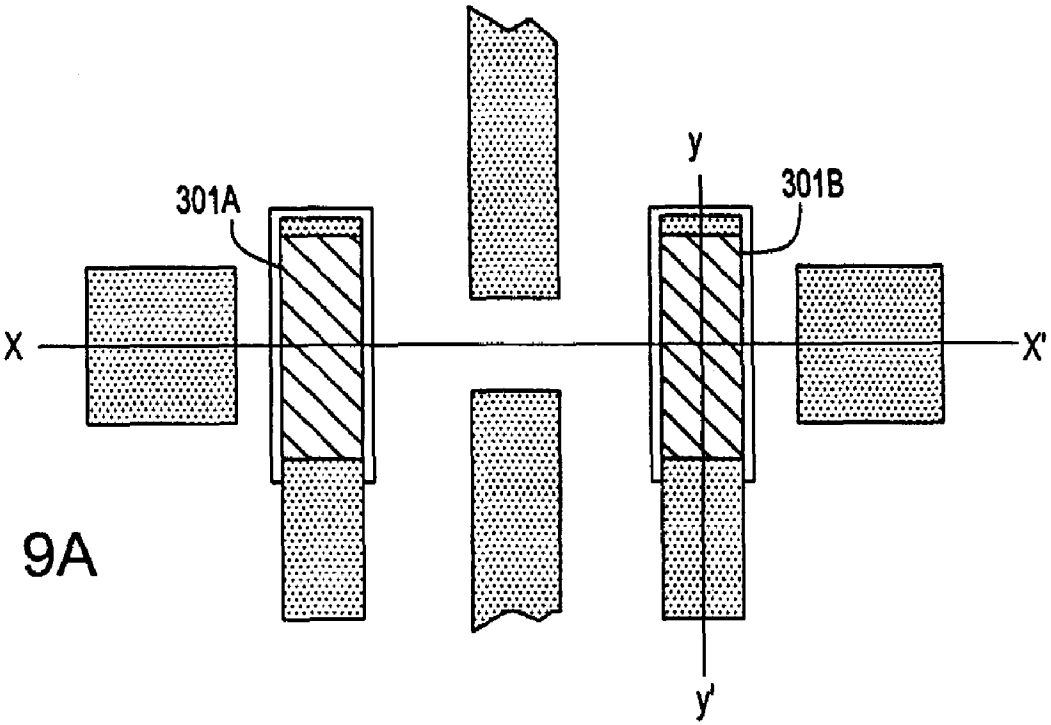
Figure 9B:
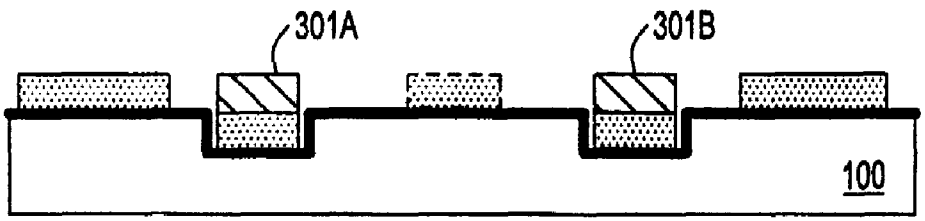

Referring now to FIG. 9, a dielectric layer, such as a $SiO_2$ ("oxide"), silicon nitride ("nitride"), silicon oxynitride, silicon carbide, silicon oxycarbide, or any other dielectric 301 is deposited on the wafer, preferably utilizing the CVD-type process described above. Deposition precursors include $SiH_4$, $SiH_3(CH_3)$, $SiH_2(CH_3)_2$, $SiH(CH_3)_3$, $Si(CH_3)_4$, TEOS, TMCATS, OMCTS, $O_2$, CO, $CO_2$, NO, He, Ar, $N_2$, $NH_3$, or any other gas known to those skilled in the art. Alternately, the dielectric may be an organic film such as SiLK™, PAE, paralyene, BCB, or a polyamide film deposited by either a CVD-type process or a spin-on process. It is patterned so that it covers portion of the metallic electrodes 301A and 301B within the depletion regions. Patterning is reformed through a combination of photolithography and plasma etching as described above. It is desirable that the thickness of the dielectric material coincide with the depth of the depletion regions. As shown in FIG. 9B, since the thickness of the dielectric 301 is about the same as that of the first metal, the top surface of the metal deposited outside the depletion regions is substantially coplanar with the top surface of the dielectric material 301B that is deposited on top of the metal within depletion regions 102A and 102B.

Figure 10C:
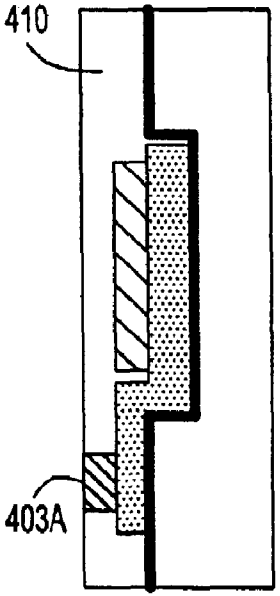
Figure 10A:
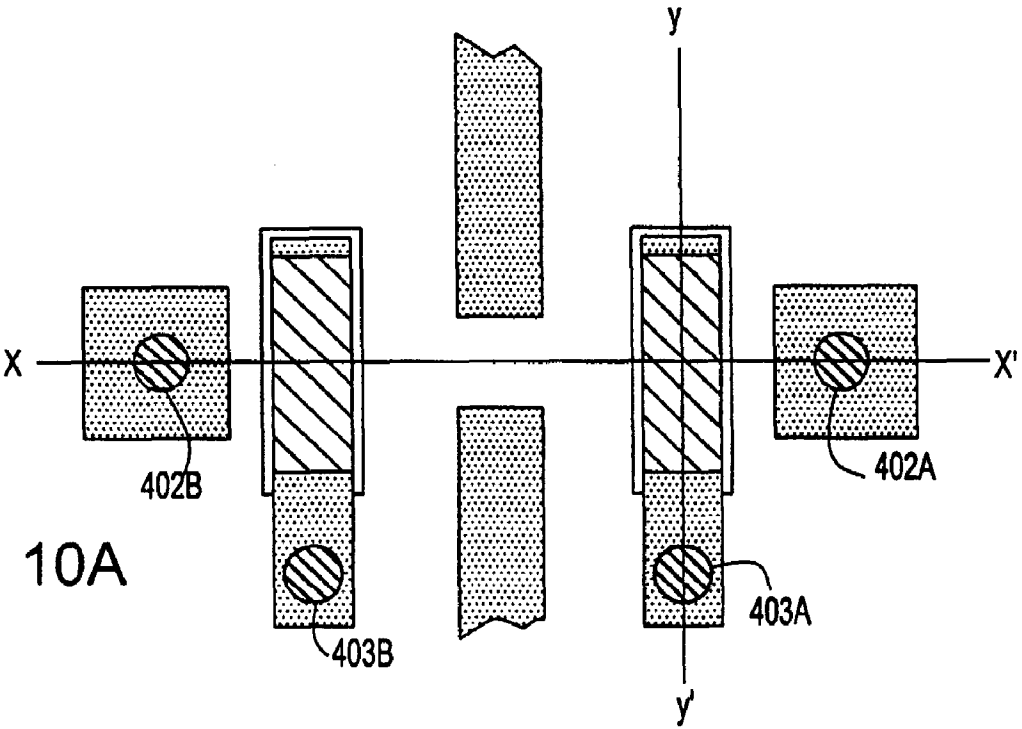
Figure 10B:
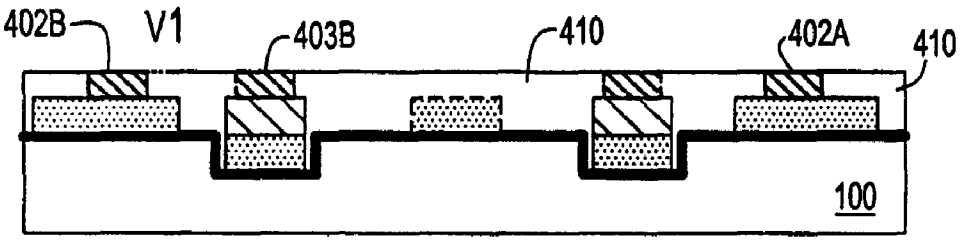

In FIG. 10, insulation layer 410, e.g., a silicon-based oxide film is deposited and planarized using conventional CMP. Through vias are formed in areas where interconnects are expected by etching a hole 402A-402B and 403A-403B in the insulating material, stopping at the first metal wiring utilizing photolithography and plasma etching described above. Once the vias are etched, proper liners and metal materials are deposited and subsequently removed utilizing CMP, forming the metal studs. Metal studs 402A and 402B eventually become part of the post to form the hinges. Studs 403A and 403B form the interconnection links to the bottom electrode pair.

Figure 11C:
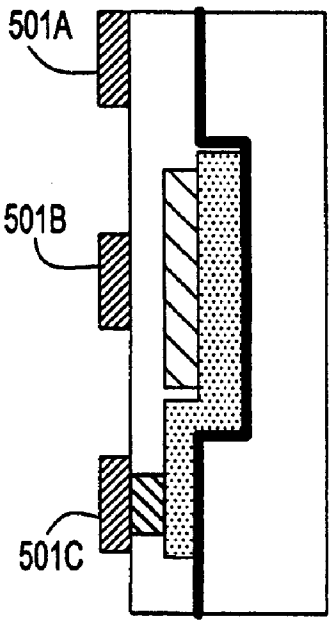
Figure 11A:
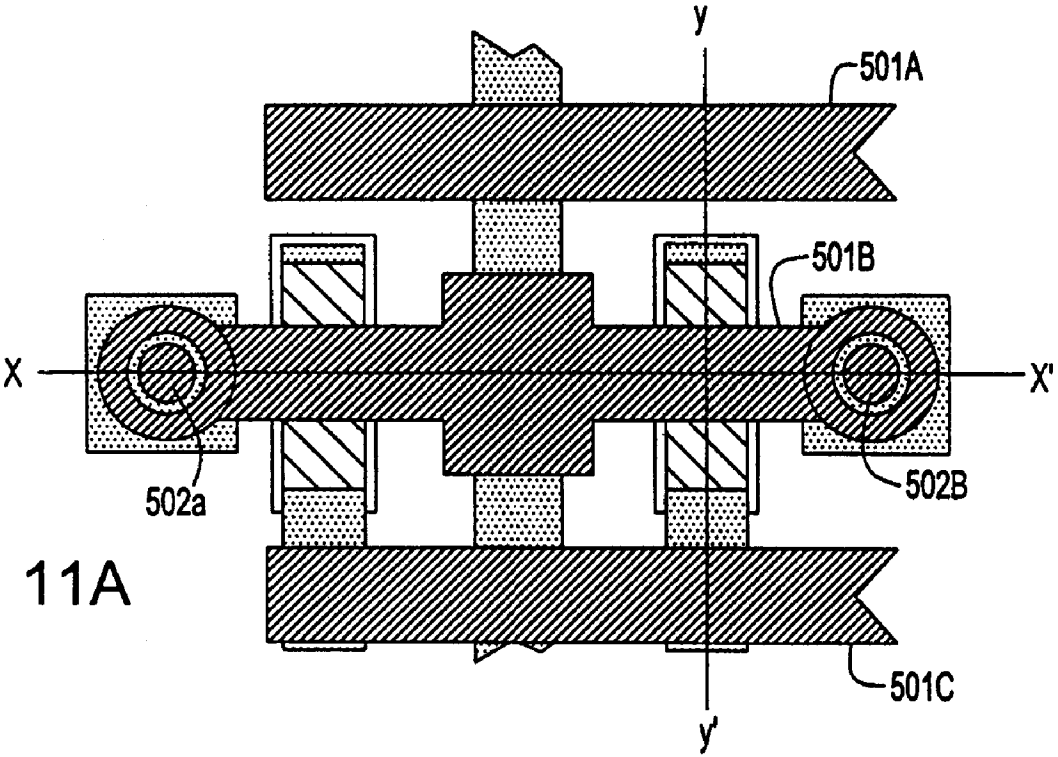
Figure 11B:
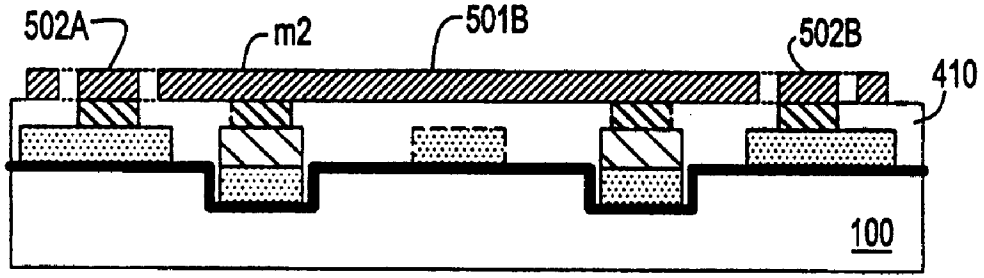

In FIG. 11, the second metallization layer (m2) is deposited in a similar manner to the first metallization layer (m1). Metal wiring is formed using a conventional "mandrill" etching or Damascene process, as described above. Wiring 501C is prepared to link the two lower electrodes, while metal wiring 501A will link the upper electrode pair (not yet formed). Wiring 501B forms the conductive plate and the two holding rings for the hinges. Portions of 501B are also used to form the hinge posts. After etching, the conductive plate is still sitting on top of insulating material 410.

The space between the inner edge of the holding ring of the conductive plate and the outer edge of the post column is, preferably, the same as the ground rule (defined as the minimal printable pattern size). Of course, it is desirable to provide a space larger than the minimal ground rule to allow the MEMS switch plate to move freely.

Figure 12C:
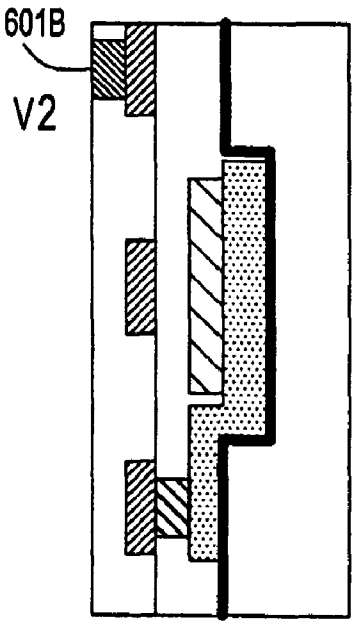
Figure 12A:
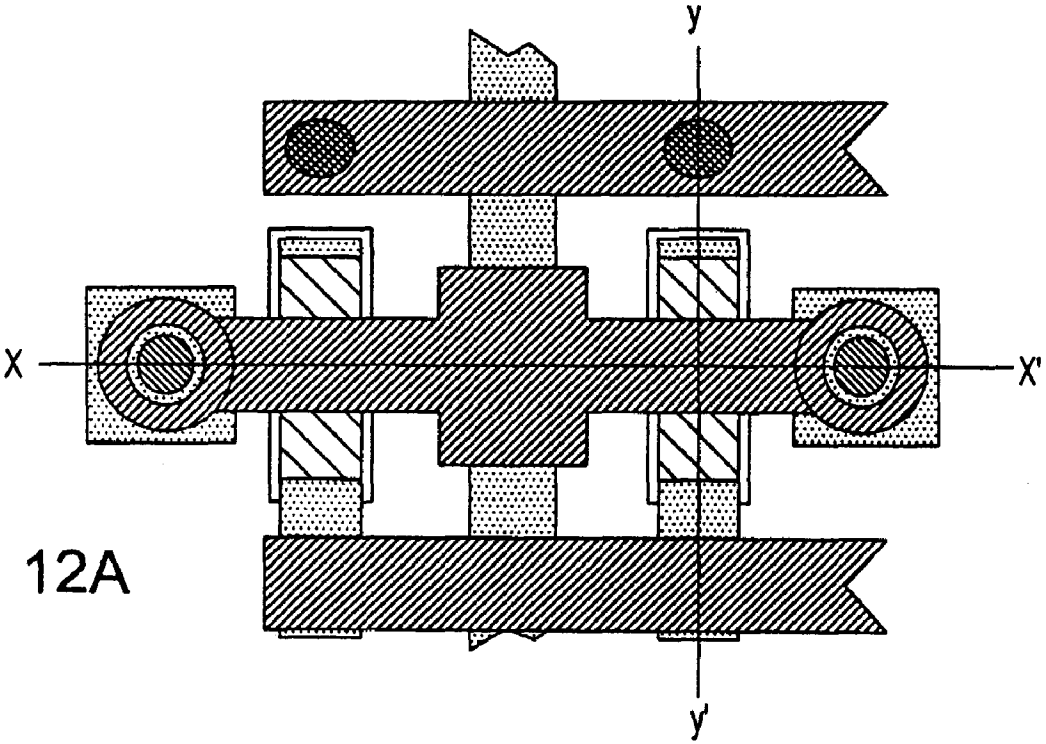
Figure 12B:
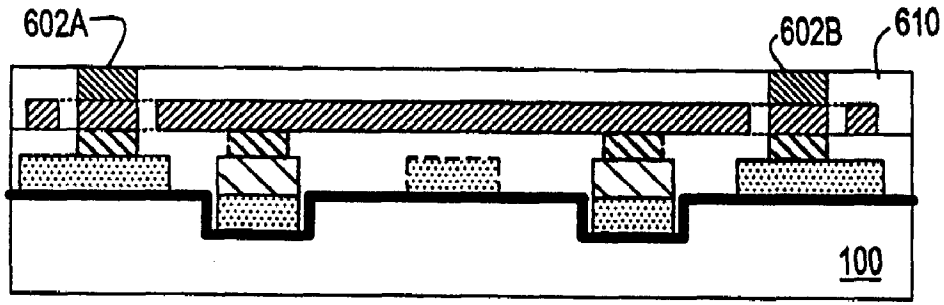

In FIG. 12, another dielectric layer 610 is deposited on top the second metallization layer (m2) utilizing the same method previously described for layer 301. Once again, vias are formed on top of 502A and 502B, respectively, forming posts 602A and 602B. Likewise, interconnects 601A and 601B on top of metal wiring 501A provide a link to the upper electrode pair (not yet formed). In the present example, second metal (m2) is advantageously used to provide interconnections to the lower or upper electrodes, allowing voltage to be applied to the upper (or lower) electrode pairs via second metal (m2). Of course, first metal (m1) can also be used to connect voltage to the lower electrodes and third metal (m3) to provide a link to the upper electrodes, utilizing for this purpose photolithography and plasma etching, as previously described.

Figure 13C:
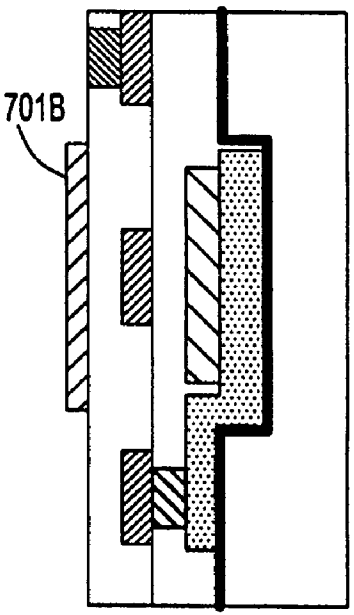
Figure 13A:
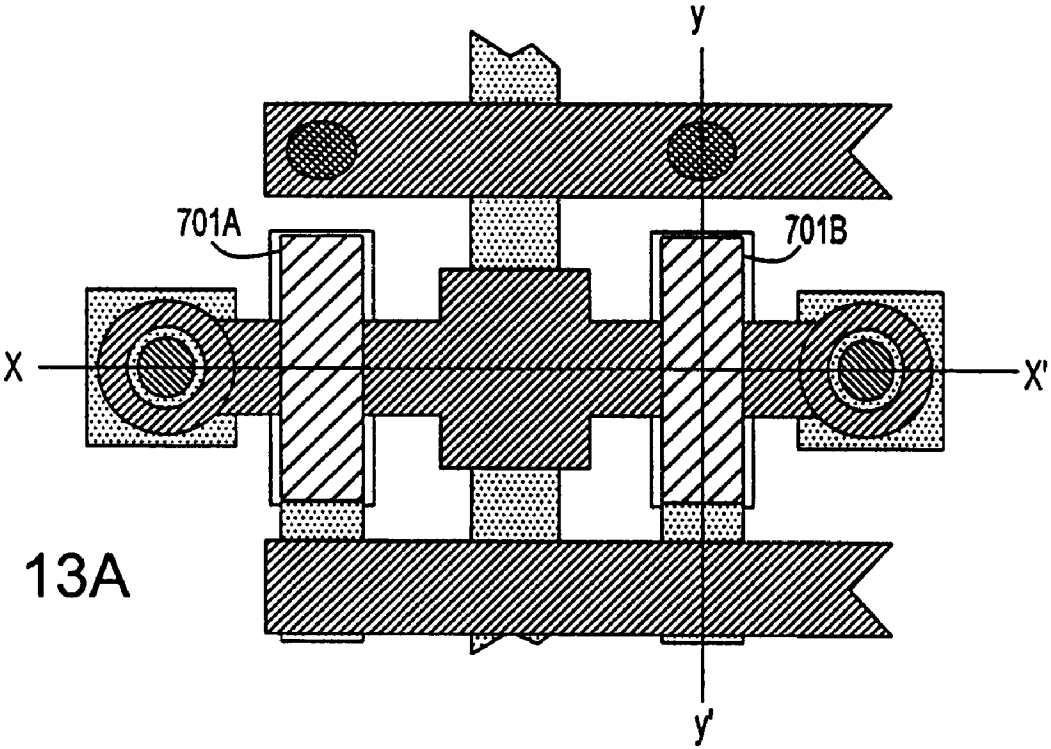

Referring to FIG. 13, dielectric layers 701A and 701B, preferably made of nitride, oxide, and the like, are deposited and patterned with photolithographic and plasma etching to form the upper electrode. Dielectric pads are constructed in the same locations as the depletion regions to serve as insulators for the upper electrodes.

Figure 13B:
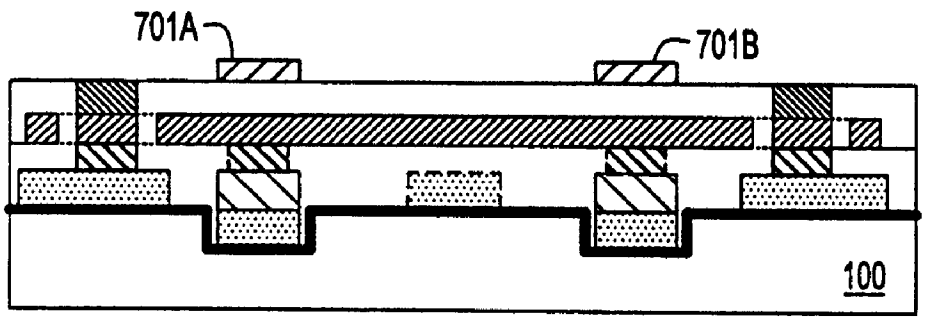
Figure 14C:
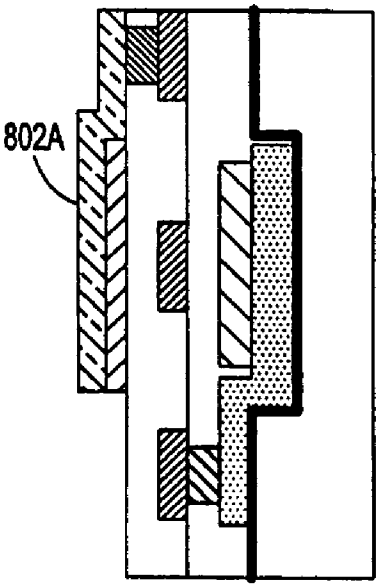
Figure 14A:
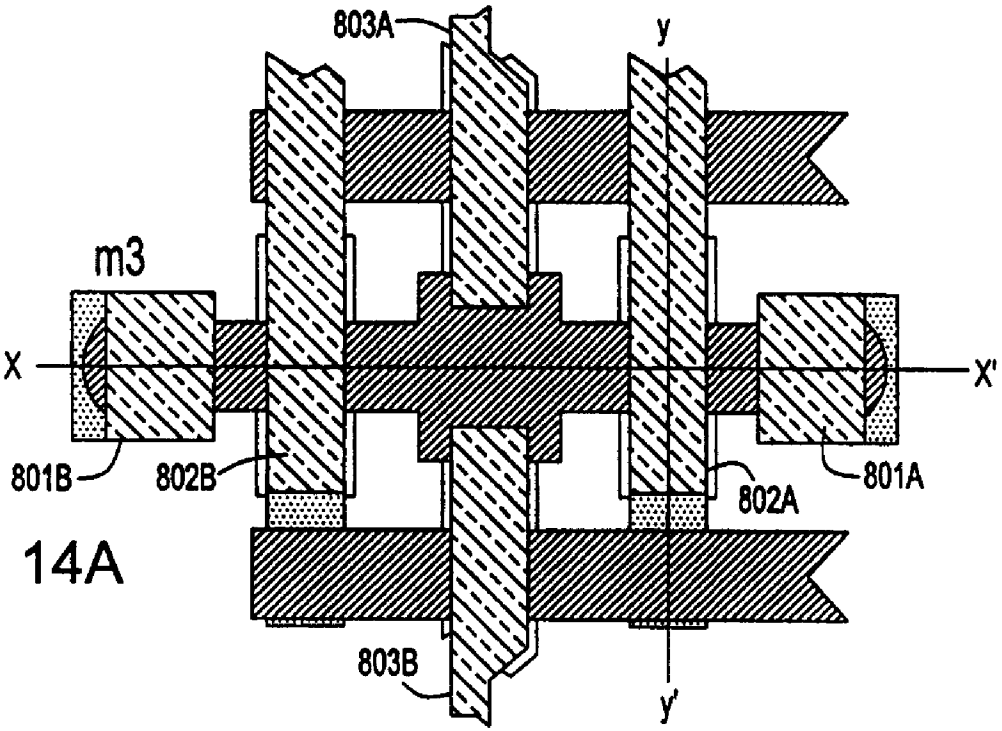
Figure 14B:
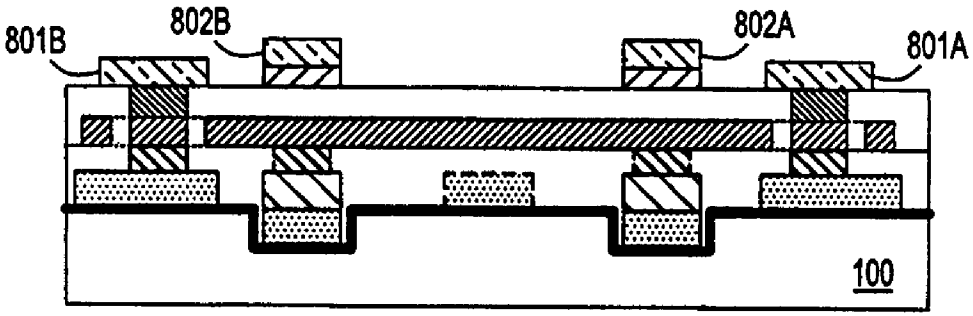

In FIG. 14, a third metallization (m3) layer is deposited, in a manner similar to the deposition of first and second metal (m1 and m2), preferably by way of conventional etching. More specifically, metal 801A and 801B are formed on top of posts 602A and 602B, respectively, forming the post caps. Similarly, metals 802A and 802B, also part of third metal (m3) are formed to become the top electrode pair. Metals 803A and 803B are respectively deposited on top of 701A and 701B to provide the top metal for the interconnections. As previously shown in FIG. 11B, the conductive plate 501B is designed to ultimately move vertically, attracted by the upper and lower electrode pairs, shorting the two top wires 803A and 803B at the exclusion of the electrodes themselves, due to the presence of second dielectric 701A and 701B (FIG. 13B). Similarly, the conductive plate moves downward attracted by the lower electrode pair, shorting the two lower interconnect wires 202A and 202B (FIG. 8A) at the exclusion of the electrodes themselves, due to the presence of the first dielectric material.

Figure 15C:
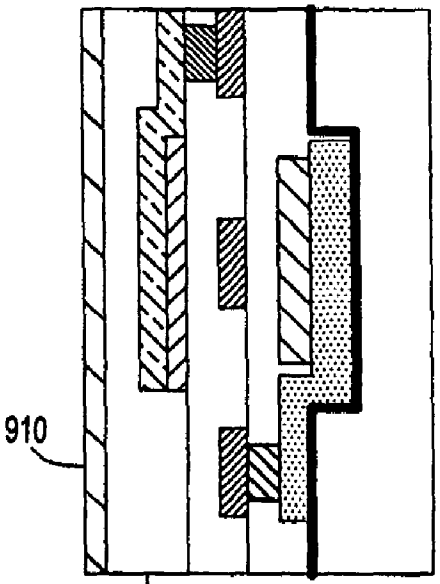
Figure 15A:
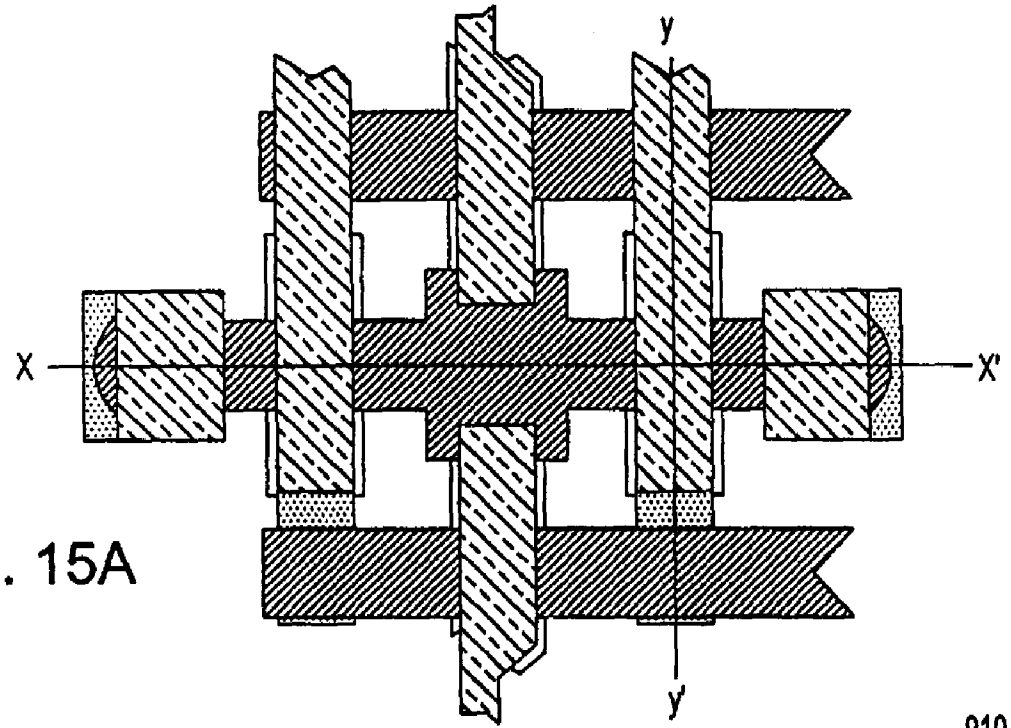
Figure 15B:
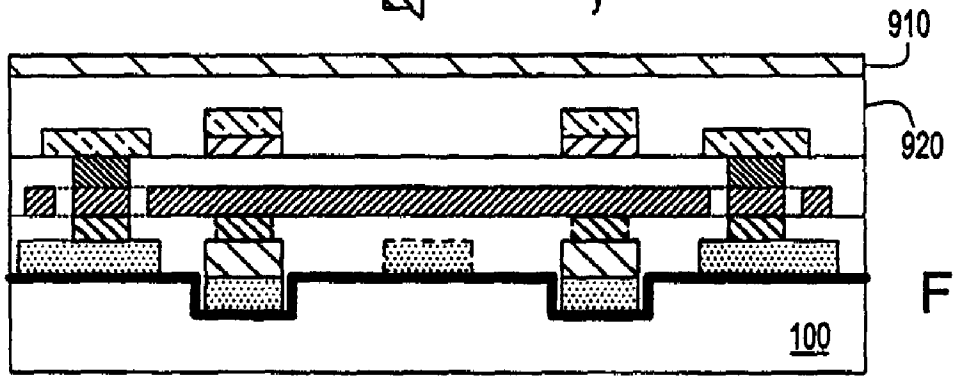

In FIG. 15, a final dielectric layer 910 is deposited as a blanket deposition on top of the structure thus formed, and planarized, preferably by CMP, in order to seal the hinge switch. A top cap material 920 is then deposited on top of the final dielectric layer. This top cap is advantageously made of $Al_2O_3$, $Ta_2O_5$, yitria, silicon nitride, intrinsic or lowly-doped polysilicon or amorphous-silicon and the like. The requirement is that top cap 920 exhibit an etch selectivity with respect to the final dielectric layer 910 greater than 2:1 and, preferably, greater than 10:1 .

Figure 16C:
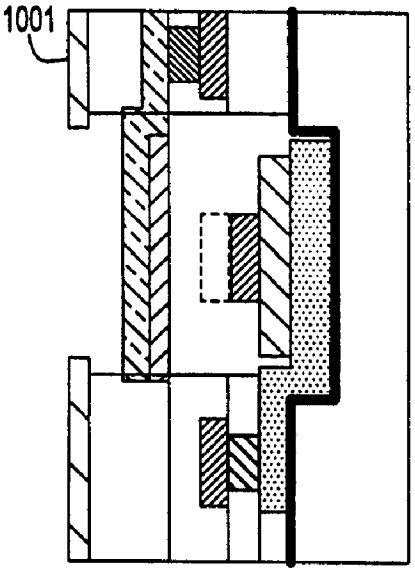
Figure 16A:
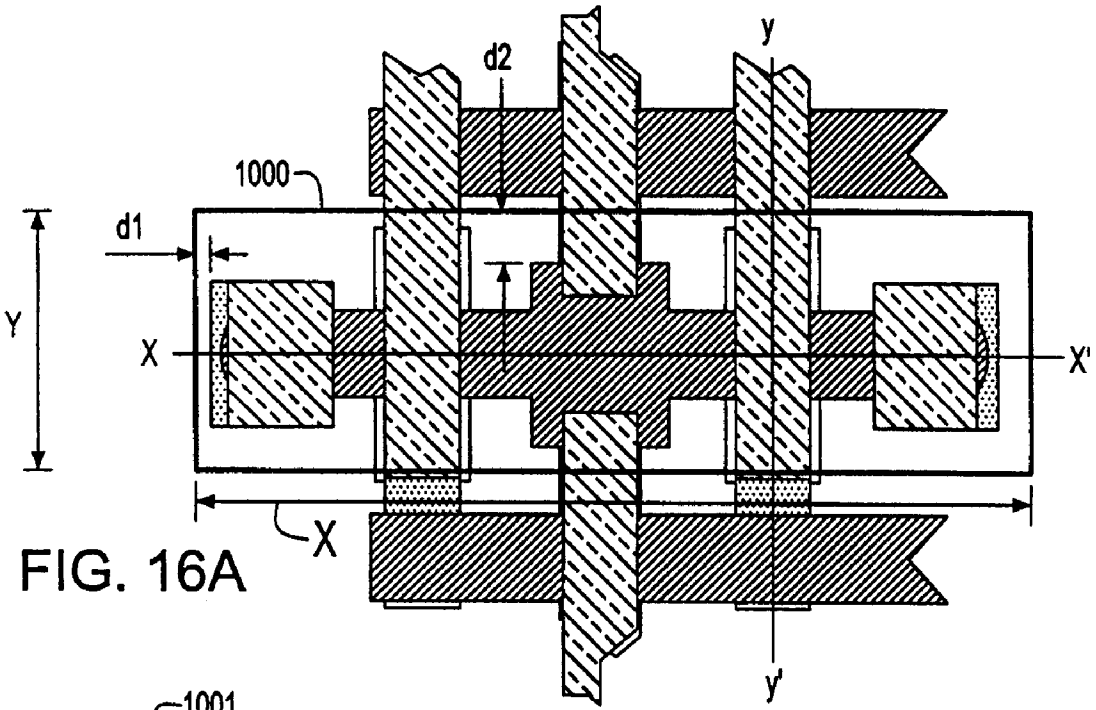
Figure 16B:
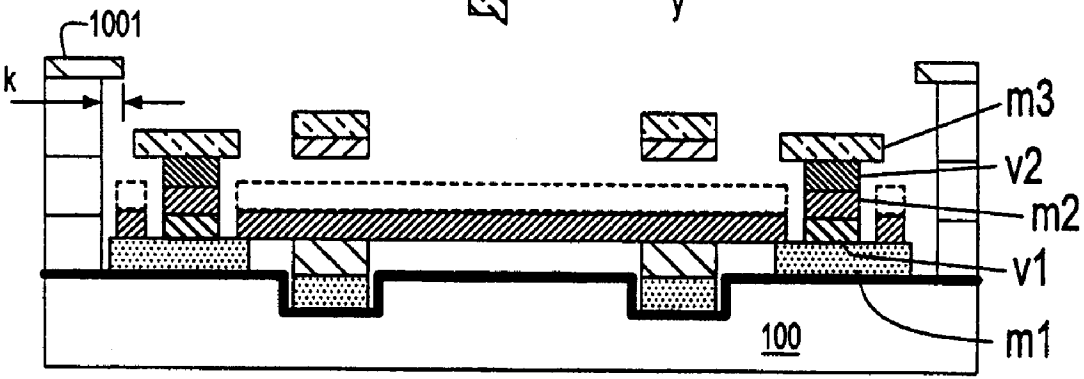

Referring to FIG. 16, the cavity is provided having proper width (X) and length (Y) dimensions. X should preferably be 2(d1) wider than the MEMS switch in the horizontal dimension, while d1 is the margin to ensure that the post areas are within the cavity. Y should preferably be 2(d2) longer than the MEMS switch in the vertical dimension, d2 being the margin to ensure that the entire plate is within the cavity. The margins d1 and d2 should be at least equal to the minimal ground rules or minimal printable dimensions.

In the last step, the top cap dielectric material deposited on the topmost dielectric layer is patterned using photoresist. The cap is then opened using $Cl_2$ plasma. Subsequently, the insulating material is etched away using the cap layer as a hard mask until the bottom stop etch layer is exposed. When all the insulating material within the cavity has been removed, the conductive plate drops from its original location marked in dashed shape to make contact with the first metal (m1).

Undercutting 'k' is controlled by first using a directional etch to remove the exposed insulating material, and then using an isotropic etch to remove the hidden material underneath the metal. The maximum undercutting should preferably be one-half the size of the widest metal to ensure that all the insulating material between the various metal layers within the cavity is totally removed. Thus, a suitable choice for dielectric films allows insulating material to be easily removed in the cavity early definition phase is critical. Examples of cavity formation include the use of an aqueous HF solution to remove silicon dioxide-based dielectrics or an oxygen-based plasma etch to remove organic based dielectrics (e.g., SiLK™)

Preferable dimensions for a MEMS switch thus described are listed hereinafter:

Width: W=5-20 um;

Length: L=1-10 um; and

Height: H=2-10 um.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A micro-electromechanical system (MEMS) switch comprising:

upper and lower electrodes;

a rigid movable conductive plate positioned between said upper and lower electrodes; and guiding elements coupled to said rigid movable conductive plate comprising two vertical posts respectively coupled to rings integral to said movable conductive plate positioned on opposing edges of said movable conductive plate and providing a movement of said rigid movable conductive plate in a translational motion between said upper and lower electrodes, said rigid movable conductive plate making electric contact with interconnect wiring remaining electrically insulated from said upper and lower electrodes.

2. The MEMS switch as recited in claim 1, wherein the movement of said rigid movable conductive plate is in an upward and downward motion.

3. The MEMS switch as recited in claim 1, wherein said movable conductive plate is attracted, respectively, by said upper and lower electrodes when alternatively energized.

4. The MEMS switch as recited in claim 1, wherein said upper and lower electrodes are energized by a voltage not exceeding 3 volts.

5. The MEMS switch as recited in claim 1, wherein said rigid movable conductive plate maintains a substantially horizontal position while moving in an upward and downward motion.

6. The MEMS switch as recited in claim 1 wherein said vertical posts are inserted within said rings to inhibit said movable conductive plate from moving laterally.

7. The MEMS switch as recited in claim 1, wherein said upper and lower electrodes are respectively placed in cavities etched in said substrate, and said interconnects are positioned on said substrate, such that only AC electrical contact is made between said movable conductive plate and said upper and lower electrodes, and DC electric contact is made between said interconnect and said movable conductive plate.

8. The MEMS switch as recited in claim 1, wherein each of said vertical posts is comprised of a column respectively ending in a top and bottom cap.

9. The MEMS switch as recited in claim 1, wherein coplanar interconnect wires are respectively opened and shorted by said movable conductive plate.

10. The MEMS switch as recited in claim 9, wherein said interconnect wires are respectively co-planar with said upper and lower electrodes.

11. The MEMS switch recited in claim 1 wherein said upper electrodes face corresponding ones of said lower electrodes.

12. A micro-electromechanical system (MEMS) switch comprising:

upper and lower electrodes;

a movable conductive plate positioned between said upper and lower electrodes; and guiding elements coupled to said movable conductive plate guiding a movement of said movable conductive plate between said upper and lower electrodes, said movable conductive plate making electric contact with interconnect wiring remaining electrically insulated from said upper and lower electrodes, said guiding elements being comprised of two vertical posts respectively coupled to rings integral to said movable conductive plate, and positioned on opposing edges thereof.

13. The MEMS switch as recited in claim 12, wherein said guiding posts are inserted within said rings to inhibit said movable conductive plate from moving laterally.

* * * * *